US006328680B1

(12) United States Patent
Shifferaw

(10) Patent No.: US 6,328,680 B1
(45) Date of Patent: Dec. 11, 2001

(54) ABDOMINAL EXERCISE WHEEL

(76) Inventor: Tessema Dosho Shifferaw, 3000 Giant Rd., San Pablo, CA (US) 94806

( * ) Notice: Subject to any disclaimer, the term of this patent is extended or adjusted under 35 U.S.C. 154(b) by 0 days.

(21) Appl. No.: 09/517,800

(22) Filed: Mar. 2, 2000

Related U.S. Application Data

(60) Provisional application No. 60/126,816, filed on Mar. 30, 1999, and provisional application No. 60/141,873, filed on Jul. 2, 1999.

(51) Int. Cl.[7] ..... A63B 21/22
(52) U.S. Cl. ..... 482/132; 127/907
(58) Field of Search ..... 482/127, 132, 482/907, 116, 126, 121, 96, 52, 139, 131, 133, 148

(56) References Cited

U.S. PATENT DOCUMENTS

| | | | | |
|---|---|---|---|---|
| D. 306,886 | | 3/1990 | Shiek et al. . | |
| 1,824,920 | | 9/1931 | Novak . | |
| 2,821,344 | | 1/1958 | Lykken et al. . | |
| 2,821,394 | * | 1/1958 | Barbeau | 482/132 |
| 3,403,906 | * | 10/1968 | Burzenski | 482/132 |
| 3,616,794 | * | 11/1971 | Gromala | 482/132 |
| 3,752,475 | * | 8/1973 | Ott | 482/132 |
| 3,938,803 | * | 2/1976 | Wilmoth et al. | 482/132 |
| 4,892,305 | | 1/1990 | Lynch et al. . | |
| 5,433,685 | | 7/1995 | Winslow et al. . | |
| 5,707,325 | * | 1/1998 | Chiou | 482/132 |
| 6,017,296 | | 1/2000 | Tang et al. . | |

* cited by examiner

*Primary Examiner*—Jerome Donnelly
(74) *Attorney, Agent, or Firm*—Flehr Hohbach Test Albritton & Herbert LLP

(57) ABSTRACT

Exercise wheel having a shaft, a pair of axially spaced wheels mounted on the shaft for rolling engagement with a surface, handle means adapted to be grasped by an exerciser to roll the wheels along the surface away from a starting position, and resilient means connected between the wheels and the handle means for urging the device to return to the starting position. In one disclosed embodiment, the resilient means comprises clock springs mounted inside the wheels, and in another it comprises torsion springs positioned within the handles.

13 Claims, 4 Drawing Sheets

ABDOMINAL EXERCISE WHEEL

This application claims the benefit of U.S. Provisional Application No. 60/126,816, filed Mar. 30, 1999, and U.S. Provisional Application No. 60/141,873, filed Jul. 2, 1999.

This invention pertains generally to exercise and fitness equipment and, more particularly, to an exercise wheel which is particularly suitable for use in exercising the abdominal muscles.

Heretofore, exercise wheels have been provided for use in exercising the abdominal muscles. Such devices typically consist of a wheel having a diameter of about six inches mounted in the center of a shaft, with grips on both sides of the wheel. The exerciser grasps the device by the grips and rolls the wheel back and forth along the floor or other exercising surface.

Such devices are difficult to balance and operate. After the wheel has been rolled forward away from the body, it is very difficult to roll it back to the starting position. In addition, it very difficult to keep the wheel from rolling forward too far, which puts undue stress on the lower back of the exerciser.

It is in general an object of the invention to provide a new and improved abdominal exercise wheel.

Another object of the invention is to provide an abdominal exercise wheel of the above character which overcomes the limitations and disadvantages of the exercise wheels of the prior art.

These and other objects are achieved in accordance with the invention by providing an exercise wheel having a shaft, a pair of axially spaced wheels mounted on the shaft for rolling engagement with a surface, handle means adapted to be grasped by an exerciser to roll the wheels along the surface away from a starting position, and resilient means connected between the wheels and the handle means for urging the device to return to the starting position. In one disclosed embodiment, the resilient means comprises clock springs mounted inside the wheels, and in another it comprises torsion springs positioned within the handles.

FIGS. 7*a*–7*e* and 8*a*–8*b* are operational views, illustrating use of the exercise wheel in performing different exercises.

Figure 9:
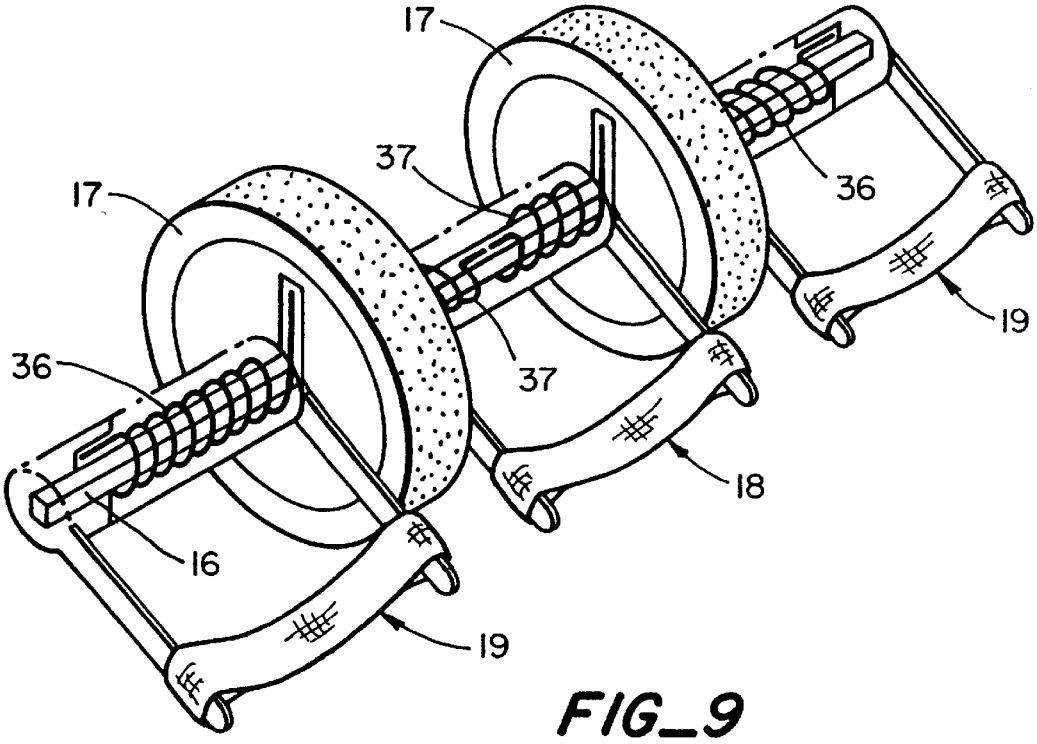

FIG. 9 is a perspective view, partly broken away, of another embodiment of an exercise wheel according to the invention.

Figure 10:
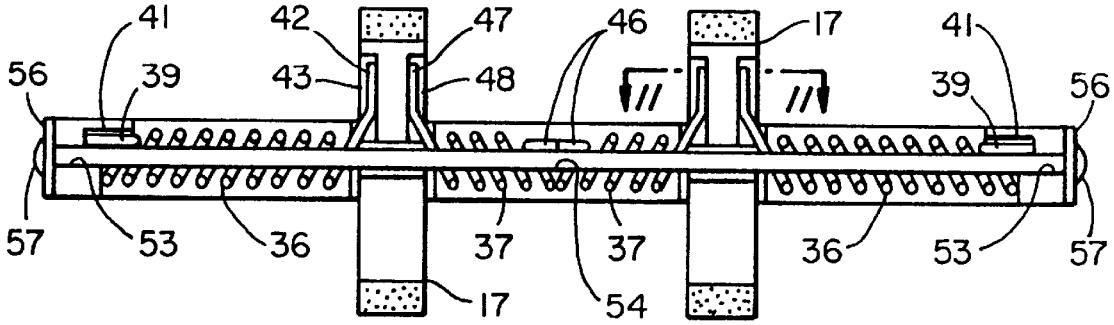

FIG. 10 is a centerline sectional view of the embodiment of FIG. 9.

Figure 11:
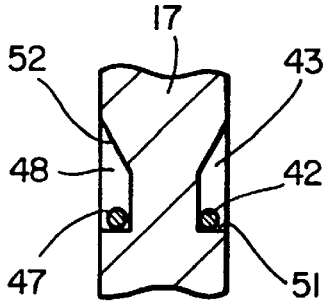

FIG. 11 is a cross-sectional view taken along line 11—11 in FIG. 10.

Figure 1:
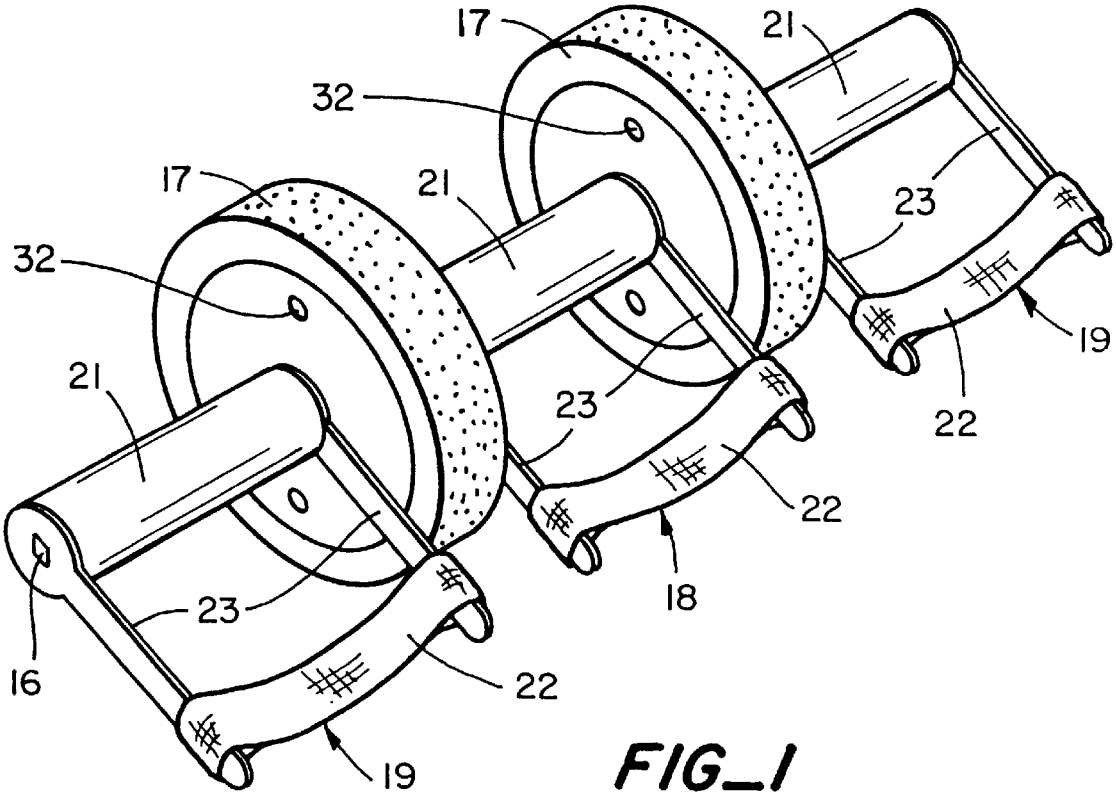
FIG. 1 is a perspective view of one embodiment of an exercise wheel incorporating the invention.
Figure 2:
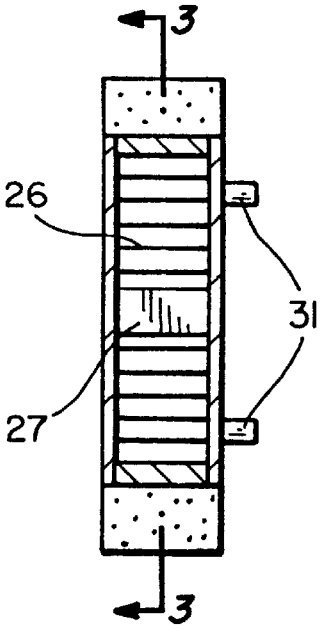
FIG. 2 is a cross-sectional view of the embodiment of FIG. 1.
Figure 3:
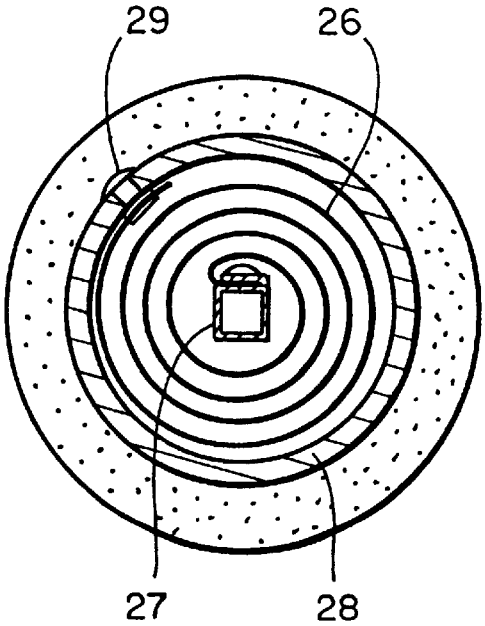
FIG. 3 is a cross-sectional view taken along line 3—3 of FIG. 2.

As illustrated in FIG. 1, the exercise device includes a shaft 16 on which a pair of axially spaced wheels 17 are mounted, with handle 18 between the wheels and handles 19 outside the wheels, ie. between the wheels and the ends of the shaft.

Each of the handles includes a cylindrical grip 21 which is adapted to be grasped by the hand of an exerciser, and an arm rest for receiving the forearm of the exerciser. Each of the arm rests comprises a flexible strap or band 22 which is attached to a pair of radially extending arms 23 affixed opposite ends of one of the grips.

The wheels are adapted for rolling engagement with the floor or another supporting surface, and means is provided for returning the device toward a rest position on the surface. That means comprises clock springs 26 mounted inside the wheels and connected between the wheels and the shaft. In that regard, the inner end of each spring is affixed to a collar 27 of non circular cross section, and the outer end is affixed to the rim 28 of the wheel by a rivet 29. In the embodiment illustrated, the collars and the shaft all have a square cross section, but they can be of any suitable noncircular shape. Hand grips 21 have a central bore of similar cross section through which the shaft passes. Thus, the inner ends of the springs are connected to the handles, and the outer ends are connected to the wheels.

The amount of force exerted by the springs can be varied by the use of interchangeable wheels having springs of different size and strength, and by using different combinations of wheels. For that purpose, each of the wheels is provided with a pair of axially extending locating pins 31 and a pair of sockets 32. That permits two or more wheels to be stacked together and rotate as a unit with a spring force equal to the sum of the forces of the springs in the different wheels. The springs provide resistance to the rolling of the wheels, prevent the wheels from being rolled too far, and assist in the return of the wheels to the starting position.

Figure 4:
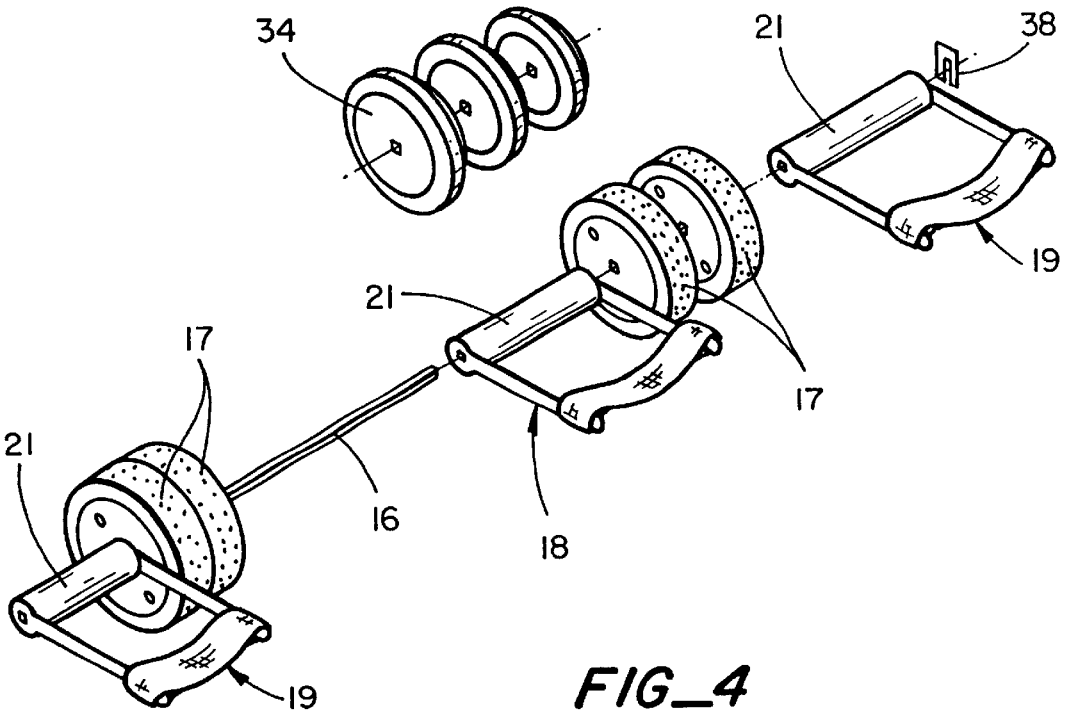
FIG. 4 is an exploded isometric view of another embodiment of an exercise wheel incorporating the invention.

FIG. 4 illustrates an embodiment which is similar to the embodiment of FIG. 1, and like reference numerals are used to designate corresponding elements in the two embodiments. In this embodiment, two wheels 17, 17 are stacked together on each side of the device, and weight plates 34 are also mounted on shaft 16 next to the wheels. The wheels, weight plates and handles are retained on the shaft by clips 38.

Figure 5:
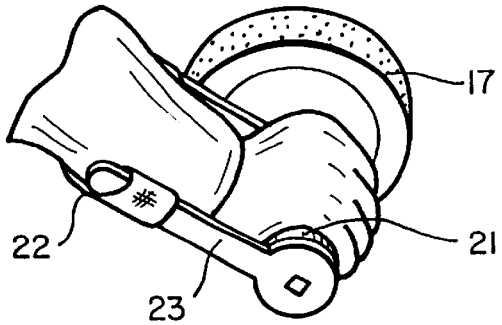
FIGS. 5 and 6 are fragmentary isometric views, illustrating hand positions for different exercises with the exercise wheel of the invention.
Figure 6:
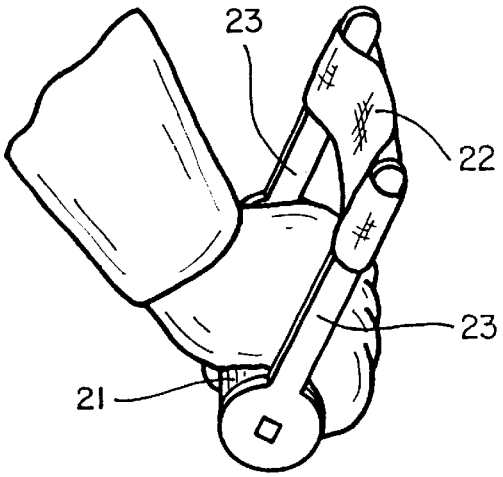

For abdominal exercises, the handles can be grasped as illustrated in FIG. 5, with the hands gripping the hand grips 21 and the forearms resting in the arm rests 22. For wrist exercises, the hands pass beneath the arm rests and grasp the hand grips, with the arm rests providing no support for the arms or wrists.

Figure 7A:
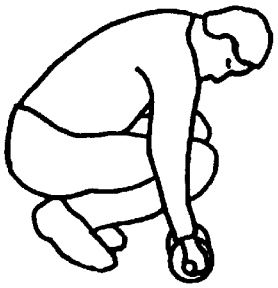
Figure 7B:
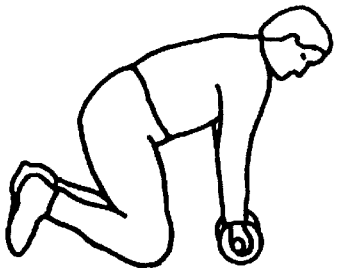
Figure 7C:
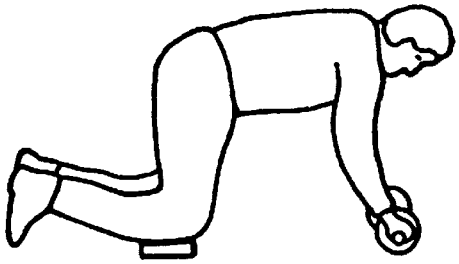
Figure 7D:
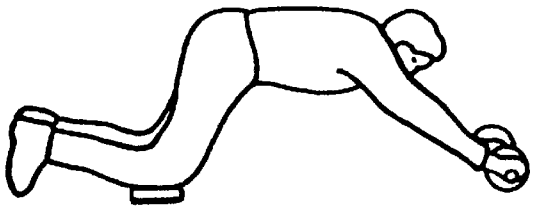
Figure 7E:
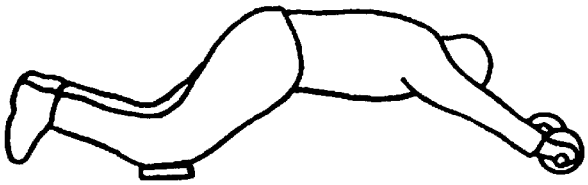

FIGS. 7*a*–7*e* illustrate the use of the exercise wheel in a front rolling exercise. For this exercise, the exerciser grips the two outer handles 19, with his forearms resting in the arm rests. He squats down, with the wheels resting on the floor, then drops to his knees as he begins to roll the wheels forward. He extends forward as the wheels roll forward, coming almost to a prone position as shown in FIG. 7*e*. The springs within the wheels provide some resistance to the rolling movement and prevent the exerciser from rolling too far.

After the exerciser reaches the extended position, he draws the device back and rolls it back to the starting position. During this part of the exercise, the springs assist him in rolling the wheels. During both parts of the exercise, the two wheels provide a more stable support than a single wheel would.

Figure 8A:
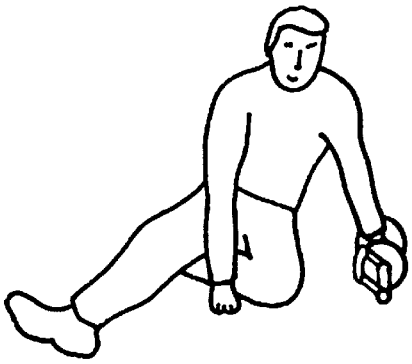
Figure 8B:
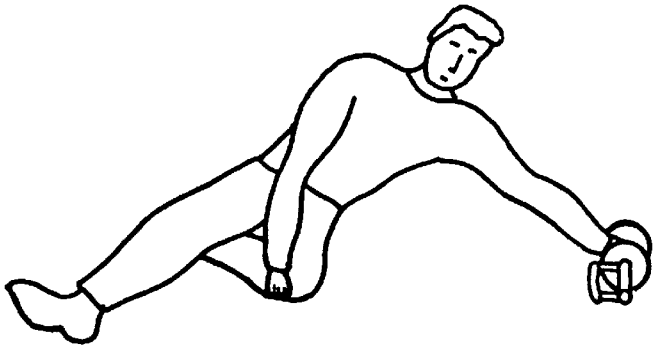

FIGS. 8*a* and 8*b* illustrate the use of the device in performing a side roll exercise. Here, the exerciser starts in a sitting position with one hand on the central handle between the wheels, rolls the device out to the side, then back in again toward his side.

If the exerciser wants to exercise his wrists and forearms as well as his abdomen, then he can grip the handle(s) with his hand(s) beneath the arm rest(s). He can then roll the device away from his body and do arm curls.

The embodiment of FIGS. 9–11 is similar to the other embodiments except that it has torsion springs 36, 37 mounted in the hand grips instead of clock springs mounted in the wheels. Torsion springs 36 are positioned coaxially between shaft 16 and the hand grips 21 of outer handles 19, and springs 37 are positioned coaxially between the shaft and the hand grip of inner handle 18.

The outer ends of springs 36 are connected to the outer hand grips by axially extending arms 39 which are received in bore holes 41 in the grips. Then inner ends of these springs are connected to the wheels by radial arms 42 which are received in drive slots 43 in the outer side faces of the wheels.

Axially extending arms 46 at the inner ends of springs 37 are affixed to the shaft, and the outer ends of these springs have radial arms 47 which are received in drive slots 48 which are similar to drive slots 43. Each of the drive slots has one side wall 51 which lies in a radial plane and provides a drive surface which engages the spring arm to wind the spring about the shaft when the wheels are rolled in a forward direction. The opposite side wall 52 of each slot is inclined so as not to engage the spring arm when the wheels are rolled in the opposite direction. Thus, if the device is rolled backward instead of forward from the rest position, the arms of the spring pass freely out of the slots, and that prevents the springs from being unwound and binding against the inner walls of the grips if the wheels are rolled in the wrong direction. Once the device has been rolled in a forward direction, the spring arms engage the drive walls 51 and urge the wheels back toward the starting position.

As in the embodiment of FIG. 1, the grips are affixed to the shaft by having bores 53, 54 of noncircular cross section similar to the shaft. The wheels and handles are retained on the shaft by washers 56 and screws 57. The outer springs are interchangeable, and the amount of resistance provided by them can be varied by using springs having different spring constants.

Operation and use of the embodiment of FIGS. 9–11 is similar to that of the other embodiments. This embodiment has an advantage over the other embodiments in that the torsion springs tend to be less expensive than the clock springs, which means that this embodiment can be manufactured more economically.

The invention has a number of important features and advantages. The two wheels provide significantly greater stability and better balance than the exercise wheels of the prior art which had only one wheel. The springs protect the exerciser against back strain or injury by preventing the device from being rolled too far, and by assisting the exerciser in rolling the device back toward the starting position. Moreover, the device can be manufactured economically, particularly the embodiment with the torsion springs.

It is apparent from the foregoing that a new and improved exercise wheel has been provided. While only certain presently preferred embodiments have been described in detail, as will be apparent to those familiar with the art, certain changes and modifications can be made without departing from the scope of the invention as defined by the following claims.

What is claimed is:

1. In an exercise device: a shaft, a pair of axially spaced wheels mounted on the shaft for rolling engagement with a surface, handles positioned between the wheels and between the wheels and the ends of the shaft, each of the handles comprising a grip disposed coaxially about the shaft and adapted to be grasped by a hand of an exerciser and an arm rest attached to the grip for receiving the forearm of the exerciser, and resilient means connected between the wheels and the handles for urging the wheels to return toward a predetermined rotational position relative to the handles.

2. In an exercise device: a shaft, a pair of axially spaced wheels mounted on the shaft for rolling engagement with a surface, handles positioned between the wheels and between the wheels and the ends of the shaft, each of the handles comprising a grip disposed coaxially about the shaft and torsion springs disposed within the grips and operably connected between the wheels and the grips, with radially extending arms of the springs being received in driving engagement in radially extending slots in the faces of the wheels.

3. The exercise device of claim 1 wherein each of the slots has a drive surface which engages the spring arm when the wheel is rolled in one direction, and an inclined surface which permits the spring arm to pass out of the slot without being engaged when the wheel is rolled in the other direction.

4. In an exercise device: a shaft, a pair of axially spaced wheels mounted on the shaft for rolling engagement with a surface, handle means adapted to be grasped by an exerciser to roll the wheels along the surface away from a starting position resilient means connected between the wheels and the handle means for urging the device to return to the starting position, and means for disconnecting the resilient means when the wheels are rolled in one direction.

5. In an exercise device: a shaft, a pair of axially spaced wheels rotatively mounted on the shaft for rolling engagement with a surface, handles affixed to the shaft and positioned between the wheels and between the wheels and the ends of the shaft, each of the handles comprising a grip disposed coaxially about the shaft and adapted to be grasped by a hand of an exerciser, and an arm rest attached to the grip for receiving the forearm of the exerciser, and resilient means disposed within the wheels and operably connected between the wheels and the shaft for returning the wheels toward a predetermined rotational position relative to the shaft.

6. The exercise device of claim 5 wherein the resilient means comprises a clock spring disposed coaxially about the shaft within each of the wheels.

7. In an exercise device: a shaft, a pair of axially spaced wheels mounted on the shaft for rolling engagement with a surface, handles positioned between the wheels and between the wheels and the ends of the shaft, each of the handles comprising a grip disposed coaxially about the shaft and adapted to be grasped by a hand of an exerciser and an arm rest attached to the grip for receiving the forearm of the exerciser, and resilient means disposed within the handles and connected between the wheels and the handles for returning the wheels toward a predetermined rotational position relative to the handles.

8. The exercise device of claim 7 wherein the resilient means comprises torsion springs disposed coaxially about the shaft and positioned within the grips.

9. In an exercise device: a shaft, a pair of axially spaced wheels mounted on the shaft for rolling engagement with a surface, handles positioned between the wheels and between the wheels and the ends of the shaft adapted to be grasped by an exerciser, and springs disposed within the handles and connected between the wheels and the handles for returning the wheels toward a predetermined rotational position relative to the handles, the springs having axially extending arms which are connected to the grips and radially extending arms which are received in driving engagement in radially extending slots in the faces of the wheels.

10. The exercise device of claim 9 wherein each of the slots has a drive surface which engages the spring arm when the wheel is rolled in one direction, and an inclined surface which permits the spring arm to pass out of the slot without being engaged when the wheel is rolled in the other direction.

11. In an exercise device: a shaft, a pair of axially spaced wheels mounted on the shaft for rolling engagement with a surface, a plurality of handles disposed coaxially about the shaft and adapted to be grasped by a hand of an exerciser, and a cylindrical torsion spring disposed coaxially about the shaft and within the handles, with one end of the spring being connected to the handles and the other end of the spring being connected to the wheel for returning the wheel toward a predetermined rotational position relative to the handles.

12. The exercise device of claim 11 wherein the end of the spring which is connected to the wheel has a radially extending arm which is received in driving engagement in a radially extending slot in the face of the wheel.

13. The exercise device of claim 12 wherein the slot has a drive surface which engages the spring arm when the wheel is rolled in one direction, and an inclined the spring arm to pass out of the slot without being engaged led in the other direction.

* * * * *